United States Patent [19]

Yashiki

[11] Patent Number: 4,914,478

[45] Date of Patent: Apr. 3, 1990

[54] IMAGE HOLDING MEMBER

[75] Inventor: Yuichi Yashiki, Yokohama, Japan

[73] Assignee: Canon Kabushiki Kaisha, Tokyo, Japan

[21] Appl. No.: 300,177

[22] Filed: Jan. 23, 1989

Related U.S. Application Data

[63] Continuation of Ser. No. 818,264, Jan. 13, 1986, abandoned.

[30] Foreign Application Priority Data

Jan. 16, 1985 [JP] Japan ..... 60-3984

[51] Int. Cl.[4] ..... G03G 15/00

[52] U.S. Cl. ..... 355/211; 29/123

[58] Field of Search ..... 355/3 R, 3 DR, 211; 29/115, 123, DIG. 1

[56] References Cited

U.S. PATENT DOCUMENTS

| | | | |
|---|---|---|---|
| 3,858,507 | 1/1975 | Owren et al. | 29/123 X |
| 4,585,324 | 4/1986 | Koyama et al. | 355/3 DR X |
| 4,607,937 | 8/1986 | Minami | 355/3 DR X |
| 4,621,919 | 11/1986 | Nitanda et al. | 355/3 DR |

FOREIGN PATENT DOCUMENTS

| | | | |
|---|---|---|---|
| 59-90878 | 5/1984 | Japan | 355/3 DR |

OTHER PUBLICATIONS

*McGraw-Hill Dictionary of Scientific and Technical Terms,* 1978, pp. 396 and 550.

*Primary Examiner*—Joan H. Pendegrass

*Attorney, Agent, or Firm*—Fitzpatrick, Cella, Harper & Scinto

[57] ABSTRACT

An image holding member comprises a hollow cylindrical photosensitive member provided with a photosensitive layer on the surface of a hollow cylinder and a bonding member to be bonded to said photosensitive member at the end portion thereof, said bonding member being adhered to said photosensitive member with a non-solvent type adhesive to be made into an integrated structure.

An image holding member comprises a hollow cylindrical photosensitive member having a photosensitive layer on the surface of a hollow cylinder provided with a projection at substantially the central portion of said cylinder on the bottom face closed at one end of said cylinder and a supporting member having a hole fittable with said projection at the central portion which is adhered to said photosensitive member with a non-solvent type adhesive to be made into an integrated structure.

9 Claims, 1 Drawing Sheet

IMAGE HOLDING MEMBER

This application is a continuation of application Ser. No. 818,262 filed Jan. 13, 1986, now abandoned.

BACKGROUND OF THE INVENTION

1. Field of the Invention

This invention relates to an image holding member for electrophotographic photosensitive members, etc. in which a cylindrical hollow substrate provided with a photosensitive layer, particularly a photosensitive layer containing an organic photoconductive material, and a supporting member are made integral in structure.

2. Description of the Prior Art

An electrophotographic copying machine is applied with several processes such as a process of imparting charges to a photosensitive member while generally rotating a cylindrical photosensitive member, a process of forming electrostatic images by imagewise exposure, a developing process which visualizes the electrostatic images by development, a process of transferring the images formed to a transfer material, e.g., paper, and the like. For rotating the photosensitive member in these processes, a supporting member called a "flange" (which also functions as the rotatory member) is arranged on both sides or one side of the cylindrical photosensitive member.

In the prior art method, the flange arranged at the end portion of the cylindrical hollow substrate was integrated with said substrate by employment of a bonding means such as screw and the like, but such a method is complicated in manufacturing steps, and besides there is a problem that it is not suitable for making electrophotographic copying machines smaller and lighter in weight.

Accordingly, the present inventor attempted to integrate the flange with the substrate with an adhesive by way of experiment and it has been found that the organic solvent which is the volatile component remaining in the adhesive after adhesion and solidification has deleterious effects on the electrophotographic characteristics. Particularly, among the electrophotographic characteristics, lowering in sensitivity, elevation in residual potential and fatigue during repeated uses were found to occur and have bad influences in formation of normal images. Also, when an electrophotographic photosensitive member having a flange and a substrate adhered and solidified with an adhesive containing a volatile component was stored inserted into a bag for protection, the minute amount of the volatile component in the adhesive adhered and solidified became filled within the bag for protection and had deleterious effects on the photosensitive layer.

SUMMARY OF THE INVENTION

An object of the present invention is to provide an image holding member which is free from lowering in sensitivity during storage.

Another object of the present invention is to provide an image holding member in which fog will not be generated.

A further object of the present invention is to provide an image holding member which can form clear images stable in continuous use of the image holding member.

According to one aspect of the present invention, there is provided an image holding member, comprising a hollow cylindrical photosensitive member provided with a photosensitive layer on the surface of a hollow cylinder and a bonding member to be bonded to said photosensitive member at the end portion thereof, said bonding member being adhered to said photosensitive member with a non-solvent type adhesive to be made into an integrated structure.

According to another aspect of the present invention, there is provided an image holding member, comprising a hollow cylindrical photosensitive member having a photosensitive layer on the surface of a hollow cylinder provided with a projection at substantially the central portion of said cylinder on the bottom face closed at one end of said cylinder and a supporting member having a hole fittable with said projection at the central portion which is adhered to said photosensitive member with a non-solvent type adhesive to be made into an integrated structure.

DESCRIPTION OF THE PREFERRED EMBODIMENTS

The image holding member according to the present invention, by use of a non-solvent type adhesive, is free from generation of the vapor of an organic solvent even after bonding of a bonding member at the end portion of the hollow cylindrical photosensitive member, whereby the effect by said vapor on the photosensitive layer can completely be prevented.

As the bonding member to be bonded to the photosensitive member, a flange for holding rotatably a photosensitive member may be typically used. Otherwise, there may be also used various members for incorporating the photosensitive member such as reinforcing members for mechanical reinforcement of the photosensitive member, members for rotational driving equipped with gears for rotation of the photosensitive member, members having rotatory supporting axis for the photosensitive member, and the like. In the present invention, a non-solvent type adhesive is used for mounting these various members on the photosensitive member. Particularly, adhesion of a supporting member for supporting the photosensitive member among these members with a non-solvent type adhesive is effective in that a supporting member with great mechanical load can be bonded simply and without occurrence of degradation of the photosensitive member. In the following, the present invention is described by referring to an example in which such a supporting member is bonded to the photosensitive member.

Figure 1:
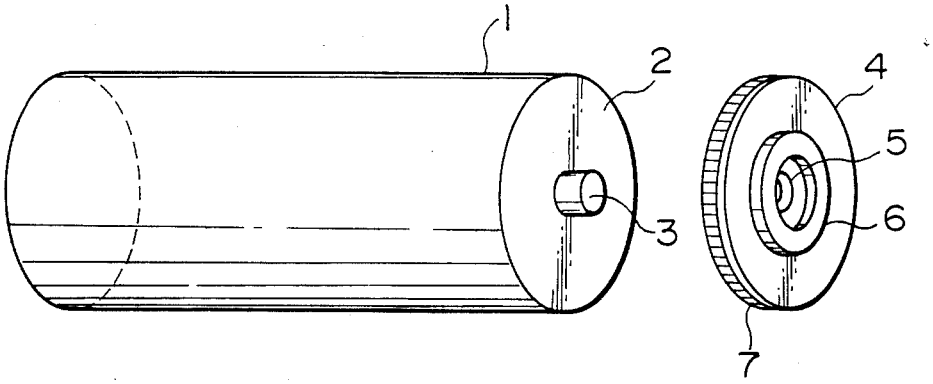
FIG. 1 is an oblique view showing an embodiment of the image holding member of the present invention.

FIG. 1 shows a hollow cylindrical photosensitive member comprising a hollow cylinder provided with a projection at substantially the central portion of the closed bottom at one end thereof and having a photosensitive layer on the surface of said cylinder, and a supporting member having a hole fittable with said projection at the central portion. FIG. 1 is a perspective view showing the manner in which the cylindrical hollow substrate 1 having a bottom 2 is bonded to the supporting member 4. A photosensitive layer formed by coating in provided on the surface of the substrate. As the photosensitive layer, there may be employed, for example, organic photoconductive layers, zinc oxide-binder layers, cadmium sulfide-binder layers, or otherwise phthalocyanines such as copper phthalocyanine, $AlCl_3$ phthalocyanine and the like, or photosensitive layers provided with charge generation layers formed by dispersing disazo pigments, trisazo pigments or the like in the binder as disclosed in Patent Laid-Open No. 2160/1980, U.S. Pat. Nos. 4356243, 4359513, 4359515, 390611, 4399206, 4418133 and 4427753, and charge transport layers as disclosed in U.S. Pat. Nos. 4315982, 391889, 4399208, 4399207, 4413045 and 4420548. In such photosensitive layers, the charge generation layer can be made to a thickness of 0.01 to 10 $\mu$, and the charge transport layer to a thickness (after drying) of about 1 to 50 $\mu$.

It is also possible to provide a subbing layer between the photosensitive member and the cylindrical hollow substrate, if desired, such as casein, polyvinyl alcohol, nitrocellulose, ethylene-acrylic acid copolymer, polyamide (nylon 6, nylon 66, nylon 610, copolymer nylon, alkoxymethylated nylon, etc.), polyurethane, gelatin, aluminum oxide and the like.

The thickness of the subbing layer may be appropriately 0.1 $\mu$ to 5 $\mu$, preferably 0.5 $\mu$ to 3 $\mu$. As the cylindrical hollow substrate, in addition to aluminum, metals such as copper, stainless steel and the like, or plastics or paper may be available. When the cylindrical hollow substrate is made of an insulating material such as plastics or paper, it is desirable to provide an electroconductive layer such as aluminum vapor deposited layer, or electroconductive resin layer or electroconductive particle-binder layer and the like.

In FIG. 1, at substantially the central portion of the bottom 2 of the hollow cylinder, a projection 3 is provided for registration with the supporting member 4 or for registration with the copying machine. By providing the supporting member with a hole 5 so as to correspond to this projection, the supporting member is fitted to the bottom. In carrying out such a fitting, the non-solvent type adhesive may be applied wholly or partially over the surface of the bottom 2, but preferably on the side surface of the projection and at the fitting portion of the hole 5, whereby both can be fitted closely together without requiring any pressing means before curing of the adhesive.

The material of the supporting member 4 to be used may suitably be a plastic. This is because of making the member lighter, as a matter of course, but also because of easiness in adhesion, easiness in bulk production and further elasticity of the material which can compensate for some errors. The plastics available may include phenol resin, amino resin, polyester resin, allyl resin, epoxy resin, polystyrene, ABS resin, acrylic resin, polyvinyl chloride resin, polyamide, polyimide, polycarbonate, polyacetal, polyphenyleneoxide, polyethylene terephthalate, polybutylene terephthalate, polyallylate, polysulfone, polyethersulfone, etc.

The non-solvent type adhesive to be used in the present invention may preferably be a combination of a liquid viscous resin (which is viscous liquid at normal temperature) with a curing agent, specifically an alpha-cyanoacrylate type adhesive or an epoxy type adhesive. As alpha-cyanoacrylate type adhesives (main adhesive component: liquid viscous resin such as methyl-$\alpha$-cyanoacrylate, ethyl-$\alpha$-cyanoacrylate and the like), there may be employed "Aron Alpha" produced by Toa Gosei Kagaku K.K. or "Eastman 910" produced by Eastman Kodak Co. The curing agent for these adhesives may be moisture in the air. On the other hand, as the epoxy type adhesives, an epoxy resin as main component which is a liquid viscous resin and a curing agent may be used, including specifically commercial products such as "Epikote 815", "Epikote 827", "Epikote 828", "Epikote 832", "Epikote 834" produced by Shell Chemical Co., "Araldite GY252", "Araldite GY250", "Araldite GY260" produced by Ciba Co., or "D.E.R. 330", "D.E.R. 331", "D.E.R. 332" produced by Dow Chemical International Co. As the curing agent, there may be used amine curing agents such as diethylenetriamine, triethylenetetramine, diethylaminopropylamine, N-aminoethylpiperazine, benzyldimethylamine, tris(dimethylaminomethyl)phenol, metaphenylenediamine, diaminodiphenylmethane, diaminodiphenylsulfone and the like. The amine curing agent may be contained at a proportion of 5 % to 35 % by weight based on epoxy resin as the main component.

It is also effective for the supporting member 4 to be provided with a rotary supporting portion 6 which is the rotary axis for the photosensitive member. The rotary supporting portion becomes a rotary axis by being fitted into the hole with the same dimension which is provided on the side of the copying machine.

Figure 2:
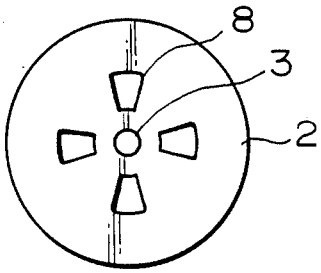
FIG. 2 is an bottom view in the case where the projection 8 for driving is formed.

Also, the supporting member 4 can conveniently have a gear 7 for transmission of power on its peripheral surface, since rotary force can be transmitted to the supporting member. In this case, the adhesive layer may sometimes be unable to stand rotary force, and therefore a driving projection 8 for driving can be formed at the bottom 2 as shown in FIG. 2 and a concavity is formed at the innerside of the supporting member so as to correspond to the projection, whereby the rotary force can be transmitted and the adhesive layer can be prevented from application of unnatural force. The shape or number of projections may be as desired, provided that they can achieve the object of the invention.

The opened portion at the other end of the photosensitive member may also be adhered similarly with a flange with a non-solvent type adhesive.

As described above, the image holding member adhered with a supporting member by use of a non-solvent type adhesive containing no volatile organic solvent as in the present invention can provide stable images without changing the characteristics of the organic photoconductive layer.

EXAMPLE 1

As a substrate, an aluminum cylinder with a shape as shown by 1 in FIG. 1 was prepared according to draw working. It had a length at the cylindrical portion of 258 mm, an outer diameter of 60 mm, with its thickness being 0.5 mm, and a projection 3 with an outer diameter of 8 mm and a height of 8 mm being formed according to integral molding.

On the other hand, 50 parts (by weight, hereinafter the same) of titanium oxide powder formed so that an electroconductive coating comprising 10% of antimony oxide and 90% of tin oxide became 43% by weight based on the total amount and 50 parts of titanium oxide powder subjected to the alumina surface treatment were dispersed by means of a ball mill in a solution comprising 90 parts of a phenol resin (trade name: J325, produced by Dainippon Ink), 10 parts of methanol and 40 parts of 2-methoxyethanol. This dispersion was adjusted to 100 m·Pa·S.

This was coated as the paint onto the substrate. Then, the coating was heated at 140° C. for 20 minutes to form an electroconductive layer with a thickness of 20 μ. This surface treatment layer was provided in order to shield the minute defects generated on the substrate surface after the draw working.

Next, 10 parts of a nylon resin (trade name: Amilan CM-8000, produced by Toray) and 10 parts of a 8-nylon resin (trade name: Toresin EF30T, produced by Teikoku Kagaku) were dissolved in 50 parts of methanol heated to 50° C. After cooled to room temperature, a mixture of equal amounts of methanol and toluene was added to adjust the viscosity to 5 m·Pa·S, followed by coating of the solution on the above electroconductive layer to form a subbing layer with a thickness of 0.5 μ.

Subsequently, 10 parts of a disazo pigment having the following formula:

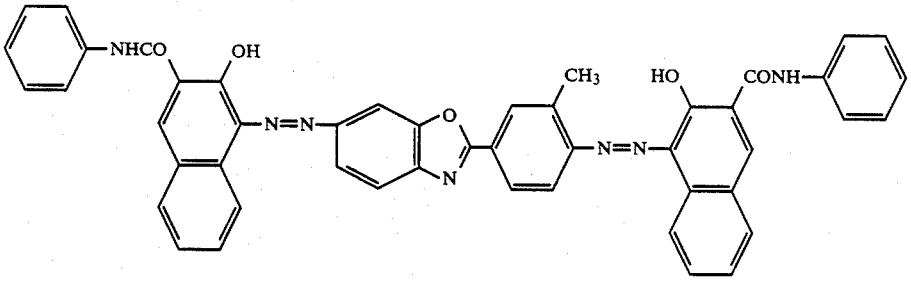

6 parts of a cellulose acetate butyrate resin (trade name: CAB-381, produced by Eastman Chemical Co.) and 60 parts of cyclohexanone were dispersed by a sand mill device using 1 ϕ glass beads for 20 hours. To this dispersion were added 100 parts of methyl ethyl ketone, and the mixture was applied on the above subbing layer by dipping, followed by drying under heating at 100° C. for 10 minutes to provide a charge generation layer with a coated amount of 0.07 g/m$^2$.

Next, 10 parts of a hydrazone compound having the following formula:

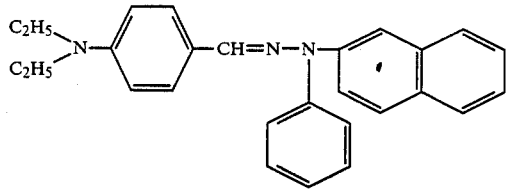

and 12 parts of a styrene-methyl methacrylate copolymer resin (trade name: MS-200, produced by Shinnittetsu Kagaku K.K.) were dissolved in 70 parts of toluene, and the resulting solution was coated onto the charge generation layer, followed by drying at 100° C. for 60 minutes, to form a charge transport layer with a thickness of 16 μ.

Figure 3:
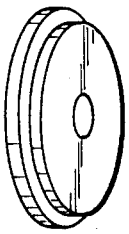
FIG. 3 is an oblique view of the flange to be set on the opening portion of the photosensitive member.

As described above, an organic photoconductive layer was formed on the substrate. And, at the bottom of the substrate, a supporting member made of a polycarbonate with a shape as shown in FIG. 1 was adhered to the substrate by coating the side portions of the projection with an adhesive with the use of "Semedine Super" adhesive produced by Semedine Co. using a bisphenol A type epoxy resin at the main component. On the other hand, at the opening portion of the substrate, a flange with a shape as shown in FIG. 3 was adhered with the use of the same adhesive.

Twenty image forming members thus prepared were stored as a stock in sealed vessel made of a polyvinyl chloride over 2 months. Sample Nos. 1–20 were given to these electrophotographic photosensitive member.

On the other hand, in adhesion of the supporting member, an adhesive with a formulation of a phenol-novolac type epoxy resin ("PC-401" produced by Haven Chemical Corporation), triethyl-tetraamine and cellosolve acetate (organic solvent) was used and the resulting samples were) stored similarly. Sample Nos. 21–40 were given to these electrophotographic photosensitive members. These samples were set in the electronic copying machine (trade name: PC10, produced by Canon K.K.) and image formation and potential measurement were carried out. The results were shown in Tables 1 and 2. Dark potential (−Vo) is the potential of the sample under charging condition adjusted so as to become the surface potential of −105V by putting round the aluminum cylinder a polyethylene terephthalate film of 25 μ. Light potential (−VL) is the potential of the sample exposed at 12 lux/second after charging of the sample.

TABLE 1

| Example | Potential and Image: Dark potential ($-V_D$) | Light potential ($-V_L$) | Numerical value indicated by concentration-adjusting lever | Image |
|---|---|---|---|---|
| Sample 1 | 710 | 240 | 5 | Clear image free from fogging |
| 2 | 700 | 230 | 5 | " |
| 3 | 710 | 230 | 5 | " |
| 4 | 700 | 235 | 5 | " |
| 5 | 690 | 240 | 5 | " |
| 6 | 695 | 240 | 5 | " |
| 7 | 700 | 230 | 5 | " |
| 8 | 710 | 235 | 5 | " |
| 9 | 700 | 235 | 5 | " |
| 10 | 700 | 240 | 5 | " |
| 11 | 710 | 240 | 5 | " |
| 12 | 715 | 230 | 5 | " |
| 13 | 700 | 230 | 5 | " |
| 14 | 700 | 235 | 5 | " |
| 15 | 700 | 235 | 5 | " |
| 16 | 690 | 230 | 5 | " |
| 17 | 700 | 235 | 5 | " |
| 18 | 710 | 240 | 5 | " |
| 19 | 700 | 230 | 5 | " |
| 20 | 710 | 240 | 5 | " |

TABLE 2

| Comparative Example | Potential and Image: Dark potential ($-V_D$) | Light potential ($-V_L$) | Numerical value indicated by concentration-adjusting lever | Image |
|---|---|---|---|---|
| Sample 21 | 700 | 300 | 5 | Fogging occurred |
| 22 | 710 | 320 | 5 | " |
| 23 | 690 | 320 | 5 | " |
| 24 | 690 | 210 | 5 | " |
| 25 | 720 | 310 | 5 | " |
| 26 | 700 | 305 | 5 | " |
| 27 | 690 | 330 | 5 | " |
| 28 | 720 | 300 | 5 | " |
| 29 | 710 | 300 | 5 | " |
| 30 | 710 | 320 | 5 | " |
| 31 | 700 | 330 | 5 | " |
| 32 | 690 | 310 | 5 | " |
| 33 | 690 | 315 | 5 | " |
| 34 | 695 | 310 | 5 | " |
| 35 | 690 | 300 | 5 | " |
| 36 | 700 | 330 | 5 | " |
| 37 | 700 | 320 | 5 | " |
| 38 | 710 | 310 | 5 | " |
| 39 | 700 | 330 | 5 | " |
| 40 | 690 | 310 | 5 | " |

Good images free from fogging were obtained from Example 1 (Samples 1–20) in which a solvent is not contained in the adhesive for the supporting member (Table 1). However, in Comparative Example (Samples 21–40) made with the adhesive in which a solvent is contained, it became plain that the lowering of the sensitivity of the photosensitive layer (inclease of light potential $V_L$) and fogging occurred by the action of the above solvent (Table 2). For removing the fogging, it was necessary to redo the adjustment such that the numerical value indicated by the concentration-adjusting lever becomes 5–8.

TABLE 3

| Example | Potential and Image: Dark potential ($-V_D$) | Light potential ($-V_L$) | Numerical value indicated by concentration-adjusting lever | Image |
|---|---|---|---|---|
| Sample 41 | 700 | 230 | 5 | Clear image free from fogging |
| 42 | 700 | 230 | 5 | " |
| 43 | 710 | 235 | 5 | " |
| 44 | 690 | 230 | 5 | " |
| 45 | 700 | 240 | 5 | " |
| 46 | 690 | 240 | 5 | " |
| 47 | 690 | 235 | 5 | " |
| 48 | 700 | 240 | 5 | " |
| 49 | 695 | 230 | 5 | " |
| 50 | 710 | 230 | 5 | " |
| 51 | 700 | 235 | 5 | " |
| 52 | 710 | 240 | 5 | " |
| 53 | 700 | 240 | 5 | " |
| 54 | 700 | 235 | 5 | " |
| 55 | 695 | 235 | 5 | " |
| 56 | 695 | 240 | 5 | " |
| 57 | 700 | 230 | 5 | " |
| 58 | 695 | 230 | 5 | " |
| 59 | 710 | 235 | 5 | " |
| 60 | 710 | 235 | 5 | " |

TABLE 4

| Comparative Example | Potential and Image: Dark potential ($-V_D$) | Light potential ($-V_L$) | Numerical value indicated by concentration-adjusting lever | Image |
|---|---|---|---|---|
| Sample 61 | 690 | 310 | 5 | Fogging occurred |
| 62 | 710 | 320 | 5 | " |
| 63 | 720 | 320 | 5 | " |
| 64 | 710 | 315 | 5 | " |
| 65 | 690 | 300 | 5 | " |
| 66 | 700 | 325 | 5 | " |
| 67 | 700 | 320 | 5 | " |
| 68 | 710 | 310 | 5 | " |
| 69 | 720 | 310 | 5 | " |
| 70 | 720 | 320 | 5 | " |
| 71 | 710 | 320 | 5 | " |
| 72 | 710 | 300 | 5 | " |
| 73 | 720 | 330 | 5 | " |
| 74 | 690 | 310 | 5 | " |
| 75 | 690 | 310 | 5 | " |
| 76 | 720 | 330 | 5 | " |
| 77 | 720 | 330 | 5 | " |
| 78 | 710 | 320 | 5 | " |
| 79 | 710 | 310 | 5 | " |
| 80 | 710 | 300 | 5 | " |

Good images free from fogging were obtained from Example 2 (Samples 41–60) made with the adhesive in which a solvent is not contained (Table 3). However, in Comparative Example (Sample 61–80) made with the adhesive in which a solvent is contained, it became plain that the lowering of the sensitivity of the photosensitive layer (inclease of light potential $V_L$) and fogging occurred by the action of the above solvent (Table 4). For removing the fogging, it was necessary to redo the adjustment such that the numerical value indicated by the concentration-adjusting lever becomes 5–8.

EXAMPLE 2

In the substrate used in Example 1, projections 8 were further provided at the bottom 2. The number of the projections was 4, with their heights being 6 mm. On this substrate, an organic photoconductive layer was formed in the same manner as in Example 1.

Next, as the supporting member, one having hole portions formed corresponding to the projections, and it was adhered with an alpha-cyanoacrylate adhesive (trade name: Aron Alpha, produced by Toa Gosei Kagaku) attached onto the central projection. Although this adhesive was weaker in adhesive force than the adhesive used in Example 1, the force applied onto the adhesive layer became smaller due to the presence of the projection for driving. When the same test as in Example 1 was conducted. The results are as shown in Table 3 below.

On the other hand, as Comparative test, in place of the adhesive used in Example 2, a synthetic rubber type adhesive containing ethyl acetate and n-hexane (trade name: High Contact, produced by Semedine Co.), and an image holding member was prepared following otherwise the same procedure as in Example 1.

The results are shown in Table 4 below.

I claim:

1. A storage stable image holding member, comprising a hollow cylindrical photosensitive member provided with a photosensitive layer containing an organic photoconductive material on the surface of a hollow cylinder and a bonding member to be bonded to said photosensitive member at an end portion thereof, said bonding member being adhered to said photosensitive member with a non-solvent type adhesive to be made into an integrated structure.

2. An image holding member according to claim 1, wherein the bonding member is a flange.

3. An image holding member according to claim 1, wherein said non-solvent type adhesive is an adhesive having a liquid viscous resin and a curing agent.

4. An image holding member according to claim 3, wherein said liquid viscous resin is an alpha-cyanoacrylate resin or a bisphenol A type epoxy resin.

5. A storage stable image holding member, comprising a hollow cylindrical photosensitive member having a photosensitive layer containing an organic photoconductive material on the surface of a hollow cylinder provided with a projection at substantially the central portion of said cylinder on a bottom face closed at one end of said cylinder and a supporting member having a hole fittable with said projection at the central portion which is adhered to said photosensitive member with a non-solvent type adhesive to be made into an integrated structure.

6. An image holding member according to claim 5, wherein said non-solvent type adhesive comprises a liquid viscous resin and a curing agent.

7. An image holding member according to claim 6, wherein said liquid viscous resin is alpha-cyanoacrylate resin or an epoxy resin.

8. An image holding member according to claim 5, wherein the side face of the projection at the central portion at the bottom of said hollow cylinder and the fitting portion of the hole of said supporting member are coated with the non-solvent type adhesive and adhered to each other.

9. An image holding member according to claim 5, wherein said supporting member is provided with a rotary supporting portion.

* * * * *

UNITED STATES PATENT AND TRADEMARK OFFICE

CERTIFICATE OF CORRECTION

PATENT NO. : 4,914,478

DATED : April 3, 1990

INVENTOR(S) : YUICHI YASHIKI

It is certified that error appears in the above-identified patent and that said Letters Patent is hereby corrected as shown below:

COLUMN 1

Line 5, "No. 818,262" should read --No. 818,264--.
Line 28, "rotatory" should read --rotary--.

COLUMN 3

Line 11, "in" should read --is--.
Line 20, "Patent Laid-Open No." should read --Japanese Patent Laid-Open No.--.
Line 21, "2160/1980, U.S. Pat. Nos. 4356243, 4359513, 4359515," should read --82160/1980, U.S. Pat. Nos. 4,356,243, 4,359,513, 4,359,515,--.
Line 22, "390611, 4399206, 4418133 and 4427753," should read --4,390,611, 4,399,206, 4,418,133 and 4,427,753,--.
Line 23, "U.S. Pat. Nos. 4315982," should read --U.S. Pat. Nos. 4,315,982,--.
Line 25, "391889, 4399208, 4399207, 4413045 and 4420548." should read --4,391,889, 4,399,208, 4,399,207, 4,413,045 and 4,420,548.--.

COLUMN 6

Line 28, "at" should read --as--.
Line 36, "member." should read --members.--.
Line 42, "were)" should read --were--.

UNITED STATES PATENT AND TRADEMARK OFFICE

CERTIFICATE OF CORRECTION

PATENT NO. : 4,914,478

DATED : April 3, 1990

INVENTOR(S) : YUICHI YASHIKI

It is certified that error appears in the above-identified patent and that said Letters Patent is hereby corrected as shown below:

COLUMN 7

TABLE 2, "24 690 210 5" should read --24 690 310 5--.
Line 62, "inclease" should read --increase--

COLUMN 8

Line 56, "Sample" should read --Samples--.
Line 59, "inclease" should read --increase--.

COLUMN 9

Line 17, "below" should read --hereinbefore--.
Line 25, "below" should read --hereinbefore--.

Signed and Sealed this

Twenty-first Day of April, 1992

*Attest:*

HARRY F. MANBECK, JR.

*Attesting Officer*

*Commissioner of Patents and Trademarks*